US007410696B2

(12) United States Patent
Zierer et al.

(10) Patent No.: US 7,410,696 B2
(45) Date of Patent: Aug. 12, 2008

(54) POLYOXYMETHYLENE FIBERS, PRODUCTION THEREOF AND USE THEREOF

(75) Inventors: Dirk Zierer, Hofheim (DE); Rainer Bernstein, Groβ-Umstadt (DE); Jörg Schweitzer, Groβ-Zimmern (DE); Klaus Kurz, Kelsterbach (DE)

(73) Assignee: TICONA GmbH (DE)

( * ) Notice: Subject to any disclaimer, the term of this patent is extended or adjusted under 35 U.S.C. 154(b) by 307 days.

(21) Appl. No.: 11/328,635

(22) Filed: Jan. 10, 2006

(65) Prior Publication Data

US 2006/0154060 A1 Jul. 13, 2006

Related U.S. Application Data

(60) Provisional application No. 60/644,762, filed on Jan. 18, 2005.

(51) Int. Cl.
*D02G 3/00* (2006.01)

(52) U.S. Cl. ..... 428/364; 428/394; 264/178 F; 264/210.5; 264/210.7

(58) Field of Classification Search ..... 428/364, 428/394; 264/178 F, 210.5, 210.7, 210.8, 264/211.12
See application file for complete search history.

(56) References Cited

U.S. PATENT DOCUMENTS

| | | | | |
|---|---|---|---|---|
| 3,309,216 | A * | 3/1967 | Willems | 428/221 |
| 3,347,969 | A * | 10/1967 | Moelter | 264/210.5 |
| 3,536,219 | A * | 10/1970 | Williams | 264/210.7 |
| 3,536,673 | A * | 10/1970 | Paolo | 264/78 |
| 4,493,751 | A | 1/1985 | Cherdron et al. | |
| 6,818,294 | B2 * | 11/2004 | Kikutani et al. | 428/364 |

FOREIGN PATENT DOCUMENTS

| | | |
|---|---|---|
| DE | 1 660 287 | 12/1970 |
| DE | 29 47 490 | 6/1981 |
| EP | 1 321 546 | 6/2003 |
| EP | 1 431 428 | 6/2004 |
| GB | 1147594 | 4/1969 |
| JP | 1-172821 | 7/1989 |
| JP | 2001172821 | 6/2001 |

* cited by examiner

*Primary Examiner*—N Edwards
(74) *Attorney, Agent, or Firm*—Connolly Bove Lodge & Hutz LLP

(57) ABSTRACT

Described are fibers comprising a polyoxymethylene copolymer having an ISO 1133 MVR melt index (determined at 190° C. under a load of 2.16 kg) in the range from 0.3 to 30 ml/10 min which possess a bend recovery (measured by the double loop method in air and/or water) of not less than 125° C. These fibers are useful in brushes.

21 Claims, 1 Drawing Sheet

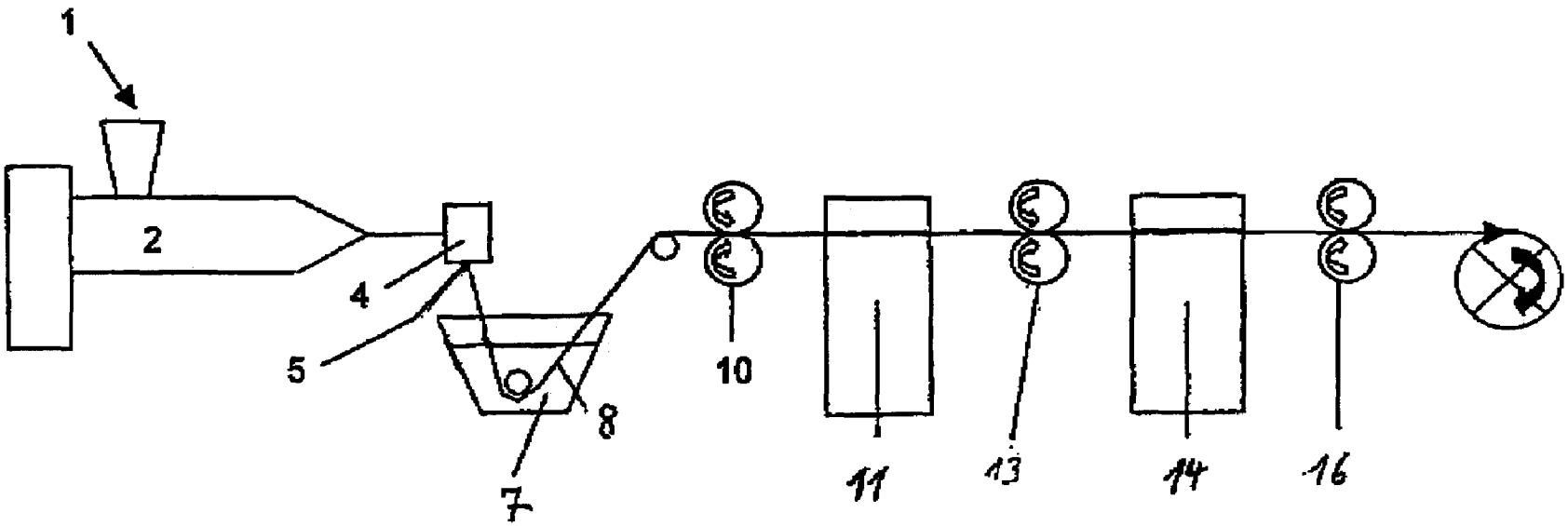
Figure

POLYOXYMETHYLENE FIBERS, PRODUCTION THEREOF AND USE THEREOF

BACKGROUND OF THE INVENTION

The present invention relates to polyoxymethylene fibers possessing high bend recovery, particularly monofilaments particularly useful as bristles in brushes of any kind.

Polyoxymethylene (hereinafter also referred to as "POM") is a high-performance polymer possessing good mechanical properties and excellent chemical resistance. Shaped articles composed of POM are notable for high crystallinity and high modulus of elasticity.

POM fibers are also known that are notable for good mechanical properties, for example high strengths and high moduli of elasticity, and that are subjected after their production to drawing at a high draw ratio to fully actualize the potential of their material of construction.

DE-A-1 660 287 discloses a process for producing filaments of high molecular weight linear POM. The process comprises producing a spinning solution of a certain viscosity and dry- or wet-spinning this solution to form POM filaments which are subsequently subjected to a drawing operation on a hot iron. Typical draw ratios vary around 10:1.

JP 2001-172821 describes the production of POM fibers by melt spinning. The process comprises melting the raw material and spinning under defined conditions and also performing a drawing operation to at least 4:1 under defined incoming and outgoing speeds. The process is notable for high productivity and produces high-strength POM filaments.

EP-A-1,321,546 describes the production of high-strength and high-modulus POM split fibers. A film is produced using selected POM copolymers having defined viscosities. The choice of raw material makes it possible to control the rate of crystallization, allowing stable film formation and controlled drawing of the film.

EP-A-1,431,428 describes high-strength and high-modulus POM fibers. They are obtained by melt spinning using POM copolymers possessing a selected crystallization rate. Again, the choice of raw material allows controlled drawing to produce fibers having very high tensile strengths.

Prior art developments were directed to the production POM fibers possessing very high tensile strengths and moduli of elasticity. However, such fibers possess low elasticity and cross-directional strength, as manifested in low knot strength and poor recovery after bending or flexing.

Against this background, the present invention has for its object to provide fibers possessing excellent bend recovery.

SUMMARY OF THE INVENTION

The present invention further has for its object to provide bristles which are very suitable for use in brushes of any kind and whose scrub resistance is excellent compared with bristles composed of other materials.

The present invention further has for its object to provide a process for producing these POM fibers which is notable for high productivity.

An example of applications combining high mechanical and chemical requirements is the use of monofilaments or bristles in brushes, such as scrubbing brushes or particularly toothbrushes. This use requires a monofilament material having excellent mechanical properties, such as high initial modulus, breaking strength, knot strength and loop strength, and also high abrasion resistance coupled with high resistance to chemicals.

BRIEF DESCRIPTION OF THE FIGURES

The FIGURE illustrates the production process for the monofilaments of the present invention.

A DETAILED DESCRIPTION OF THE INVENTION

The present invention provides fibers comprising a polyoxymethylene copolymer having an ISO 1133 MVR melt index (determined at 190° C. under a load of 2.16 kg) in the range from 0.3 to 30 ml/10 min which possess a bend recovery (measured by the double loop method in air and/or water) of not less than 125° C.

Any polyoxymethylene copolymer is useful for producing the fibers of the present invention provided it exhibits the melt indices mentioned.

Examples of suitable polyoxymethylene copolymers are to be found in EP-A-1,431,428 and in 1,321,546.

The polyoxymethylenes (POMs) as described in DE-A-29 47 490 for example generally comprise unbranched linear polymers generally containing at least 80% and preferably at least 90% of oxymethylene (—$CH_2$—O—) units.

As used herein, the term polyoxymethylenes comprises copolymers of formaldehyde or of its cyclic oligomers, such as trioxane or tetroxane, with monomers copolymerizable therewith.

Copolymers are thus polymers derived from formaldehyde and/or its cyclic oligomers, particularly trioxane and cyclic ethers, cyclic acetals and/or linear polyacetals. The hydroxyl end groups of these copolymers have been chemically stabilized to degradation in a conventional manner, for example by esterification or by etherificaton.

Such POM copolymers are well known to one skilled in the art and are described in the literature.

In general, these polymers comprise at least 50 mol % of recurring —$CH_2$—)— units in the backbone. POM copolymers are generally produced by copolymerization of formaldehyde or trioxane with suitable comonomers, preferably in the presence of suitable catalysts.

The fibers of the present invention are preferably produced using POM copolymers which, as well as the recurring —$CH_2$—O— units, comprise up to 50, preferably from 0.1 to 20 and especially 0.5 to 10 mol % of recurring

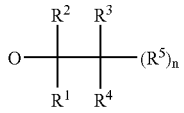

units where $R^1$ to $R^4$ are independently a hydrogen atom, a $C_1$- to $C_4$-alkyl group or a halogen-substituted alkyl group having 1 to 4 carbon atoms and $R^5$ is a —CH2— group, an —O—CH2— group, a $C_1$ to $C_4$-alkyl- or $C_1$- to $C_4$-haloalkyl-substituted methylene group or a corresponding oxymethylene group and n has the value in the range from 0 to 3.

These groups may preferably be introduced into the copolymers by ring opening of cyclic ethers. Preferred cyclic ethers are those of the formula

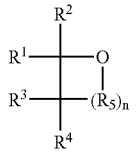

where $R^1$ to $R^5$ and n are each as defined above.

Merely illustrative examples of cyclic ethers are ethylene oxide, 1,2-propylene oxide, 1,2-butylene oxide, 1,3-butylene oxide, 1,3-dioxane, 1,3-dioxolane, 1,3-dioxepane and 1,3,6-trioxacylcooctane and merely illustrative examples of comonomers are linear oligo- or polyformals, such as polydioxolane or polydioxepane.

It is particularly advantageous to use copolymers of 99.5-95 mol % of trioxane and 0.5 to 5 mol % of one of the aforementioned comonomers.

Processes for producing the above-described POM copolymers are known to one skilled in the art and are described in the literature.

The preferred POM copolymers have melting points of not less than 140° C. and weight average molecular weights $M_w$ in the range from 5000 to 200 000 and preferably in the range from 7000 to 150 000.

End group stabilized POM copolymers having C—C bonds at the chain end or having methoxy end groups are used with particular preference for producing the fibers of the present invention.

The POM copolymers used for producing the fibers of the present invention have an ISO 1133 MVR value (190/2.16) in the range from 0.3 to 30 ml/10 min, preferably in the range from 1 to 10 ml/10 min and most preferably in the range from 1 to 3 ml/10 min.

Preferred POM copolymers, as well as recurring oxymethylene groups, comprise from 0.5 to 10 mol %, preferably from 1 to 5 mol % and especially from 1.5 to 4 mol % of structural units derived from comonomers. The latter are typically comonomers which are only bifunctional, i.e., unable to form branches or crosslinks. The POM copolymers used according to the present invention are thus essentially linear and characterized by a high crystallization half-life.

Typical crystallization half-lives for the POM copolymers used according to the present invention are not less than 30 seconds, determined by cooling from 200° C. to a temperature which is usually 10° C. below the melting temperature of that POM copolymer at a cooling rate of 80° C./minute and maintaining this temperature at this observation temperature. The time is taken once the observation temperature is reached.

Preferred POM copolymers comprise very little, if anything, by way of constituents capable of speeding the crystallization behavior. These include organic and inorganic nucleating agents, nucleating POM terpolymers or impurities generated in the course of the production of the POM copolymer. The latter may preferably be removable by reprecipitating, in which case the POM copolymer is preferably dissolved in a water-methanol mixture at temperatures from 150 to 200° C. under superatmospheric pressure.

Particular preference is given to using POM copolymers which, as well as recurring oxymethylene groups of the formula 1, comprise from 0.5 to 10 mol %, preferably from 1 to 5 mol % and especially from 1.5 to 3 mol % of oxyalkylene groups of the formula II $$—[CH_2—O]— \quad (I),$$

$$—[(CH_2)_m—O]_y— \quad (II),$$

where m is an integer from 2 to 4 and preferably is 2 and y is 1 or 2.

The MVR value of the polyoxymethylene copolymers used according to the present invention is determined in accordance with ISO 1133: 190° C./2.16 kg.

The crystallization half-life and the bend recovery of the fibers according to the present invention are determined as described in the examples hereinbelow.

Preferred polyoxymethylene copolymer fibers according to the present invention are derived from polyoxymethylene copolymers whose crystallization half-life is not less than 100 seconds and most preferably not less than 150 seconds.

Preferred polyoxymethylene copolymer fibers according to the present invention possess a bend recovery (measured by the double loop method in air and/or water) of not less than 130° C.

The polyoxymethylene copolymer fibers of the present invention typically possess a DIN 53834-1 (tensile testing of monofils) tensile strength of up to 45 cN/tex and more preferably up to 40 cN/tex.

The polyoxymethylene copolymer fibers of the present invention typically possess a DIN 53834-1 (tensile testing of monofils) breaking extension of up to 100%, more preferably in the range from 25% to 100% and most preferably in the range from 30% to 100%.

By POM copolymer fibers are herein meant any fibers comprising POM copolymer.

Examples thereof are filaments or staple fibers consisting of a plurality of individual fibers, but particularly monofilaments.

The POM copolymer fibers of the present invention are producible by the well-known melt-spinning process.

The use of a certain POM raw material and a draw ratio which is not too high are important requirements to achieve the performance profile.

The present invention also provides a process for producing the present invention's POM copolymer fibers which comprises the measures of:

i) extruding a melt of the above-described POM copolymers through a spinneret die, ii) introducing the resultant filament into a bath of liquid having a temperature of less than 150° C., iii) withdrawing the resultant filament, iv) single or multiple drawing to an overall draw ratio of not more than 6:1, and v) if appropriate, heating the drawn filament while allowing shrinkage.

One preferred embodiment of the process according to the present invention utilizes multiple drawing of the resultant filament.

The fibers of the present invention can be present in any desired form, for example as multifilaments, as staple fibers or particularly as monofilaments.

The linear density of the fibers according to the present invention can vary within wide limits. Examples thereof are 100 to 45 000 dtex and particularly 400 to 7000 dtex.

Particular preference is given to monofilaments whose cross-sectional shape is round, oval or n-angular, where n is not less than 3.

The fibers of the present invention are produced using a polyoxymethylene raw material which is stabilized to thermal degradation and which, if appropriate, may contain further additives customary for POM molding compositions.

Examples of stabilizers are antioxidants, acid scavengers, formaldehyde scavengers and/or UV stabilizers.

Examples of further additives customary for POM molding compositions are adhesion promoters, lubricants, demolding agents, fillers, such as glass spheres, calcium carbonate, talc, wollastonite or silicon dioxide; reinforcing materials, such as carbon fibers, aramid fibers or glass fibers, antistats or additives which endow the molding composition with a desired property, such as dyes and/or pigments and/or impact modifiers and/or electroconductivizers, for example carbon black or metal particles, and also mixtures of these additives, without however limiting the scope to the examples mentioned.

The fraction of these stabilizers and additives in the fibers of the present Invention is customarily in the range from 0.2% to 30% by weight and preferably in the range from 0.5% to 25% by weight, based on the mass of the fibers.

After the polymer melt or the spinning solution has been pressed through a spinneret die, the hot polymer thread is cooled in a bath of liquid. The bath of liquid has a temperature of less than 150° C.; the temperature of the bath of liquid can vary within wide limits, for example from −80° C. to 150° C. and preferably from 20° C. to 90° C. Different cooling liquids can be used, preferably water or a mixture of water and alcohol. Instead of through one cooling bath, the filament can also be passed through different cooling baths. The cooled filament is withdrawn from the cooling bath and subsequently wound up, if appropriate. The withdrawal speed is greater than the polymer melt's extrusion speed.

The fiber thus produced is subsequently subjected to drawing, preferably in multiple stages, particularly to a two- or three-stage drawing operation, to an overall draw ratio of up to 6:1 and preferably in the range from 4:1 to 6:1. Drawing can be effected on hot godets, by passing over a heated iron and/or by passing the filament through an infrared tunnel or a heating bath. Drawing temperature is preferably in the range from 150 to 190° C. and more preferably in the range from 170 to 180° C.

The drawing operation is preferably followed by a heat-setting operation, typically at temperatures in the range from 150 to 200° C.; length is maintained constant, or shrinkage is allowed.

It has been determined to be particularly advantageous for the production of the fibers of the present invention to operate at a melt temperature in the range from 180 to 230° C.

The polyoxymethylene fibers of the present invention are used, particularly in the form of monofilaments or bristles, in a wide variety of applications. Preferred fields of use are toothbrushes, hairbrushes, artists' and writing brushes, industrial brushes, paint brushes, paint rollers and paint pads, cosmetic brushes, road and domestic cleaning brushes and also bodycare brushes.

These uses likewise form part of the subject matter of the present invention.

The production process for the monofilaments of the present invention is sketched in the accompanying drawing.

Polymer pellet (1) is melted in an extruder (2) and pressed by a melt pump (4) through the fine aperture in a die plate (6). The extruded filament (8) is led through a temperature-controlled water bath (7) and, before being wound up, drawn between draw rolls (10, 13, 16) in thermal ovens (11, 14) in order that the requisite parallel alignment of the molecules may be achieved. Oven temperatures and draw ratios between the individual draw rolls are of decisive importance for the performance profile of the monofilament produced.

Some processing parameters and also properties of the monofilaments obtained are set out in the table hereinbelow. A POM copolymer was utilized in the experiments which was characterized by the following parameters:

Crystallization half-life: the crystallization of thin POM films 10-100 μm thick, melted at 200° C., was monitored under a polarizing microscope with a photocell following the rapid cooling to the particular observation temperature. The crystallization half-life is the time elapsed between the visually discernible onset of crystallization and the attainment of half the maximum light intensity. The observation temperature $T_b$ chosen for POM polymers having $T_m$ melting points was a temperature of $T_b=T_m-10K$. So, for POM types having melting points of 162° C. $T_b$ was 152° C.

MVR value: determined in accordance with ISO 1133 (MVR 190° C./2.16 kg)

Bend recovery: characterized by the double loop method. To this end, the samples were conditioned for 24 hours in a fully conditioned measuring space at 23° C. and a relative humidity of 50% (in accordance with DIN 55014-23/50-1 of July 1985).

To perform the measurement, five individual threads were each cut to a length of 600±2 mm. The individual lengths were each cut into two lengths of 300 mm, and these lengths were then knotted together to form two interlocked loops. One loop was slipped over the hook of a stand, while the second loop was used to suspend the weight calculated from the formula hereinbelow. The loading time was 5 minutes. A 180° bend was achieved for the loading, the radius of curvature coinciding with the filament radius. After unweighting, the loops were each cut open at a point 5 cm from the bend point. The cut-off first loop was relaxed on a glass plate in air for five minutes. Immediately following expiration of the five minutes the expanding angle was measured with a protractor. The cut-off second loop was relaxed in a water bath at room temperature for five minutes. On expiration of the five minutes the filament was taken from the water bath, placed on a glass plate and the expanding angle was measured there using a protractor.

The load was calculated according to the following formula:

$$G = \frac{d^2 * \pi * 1280 * 2}{4}$$

G=loading weight in grams d=fiber diameter in mm

TABLE

| Example No. | Draw roll 1 (m/min) | Oven 1 (° C.) | Draw roll 2 (m/min) | Oven 2 (° C.) | Draw ratio | Tensile stress (N/mm$^2$) | Tenacity (cN/tex) | Extension (%) | Recovery in air (degrees) | Recovery in water (degrees) | Diameter (mm) |
|---|---|---|---|---|---|---|---|---|---|---|---|
| C1 | 12 | 180 | 126 | 190 | 10.96 | 875 | 62.0 | 26.7 | 95 | 97 | 0.156 |
| C2 | 16 | 173 | 114 | 180 | 7.13 | 762 | 54.4 | 27.5 | 106 | 110 | 0.139 |
| C3 | 16 | 175 | 110 | 175 | 6.88 | 733 | 52.4 | 25.9 | 109 | 113 | 0.142 |

TABLE-continued

| Example No. | Draw roll 1 (m/min) | Oven 1 (° C.) | Draw roll 2 (m/min) | Oven 2 (° C.) | Draw ratio | Tensile stress ($N/mm^2$) | Tenacity (cN/tex) | Extension (%) | Recovery in air (degrees) | Recovery in water (degrees) | Diameter (mm) |
|---|---|---|---|---|---|---|---|---|---|---|---|
| 4 | 27 | 175 | 150 | 175 | 5.56 | 569 | 40.6 | 33.2 | 129 | 131 | 0.139 |
| 5 | 20 | 175 | 110 | 175 | 5.50 | 466 | 33.3 | 33.3 | 129 | 132 | 0.142 |
| 6 | 18 | 175 | 100 | 175 | 5.56 | 326 | 23.2 | 34.7 | 130 | 133 | 0.139 |
| 7 | 16 | 175 | 90 | 175 | 5.63 | 222 | 15.9 | 46.0 | 131 | 132 | 0.137 |
| 8 | 18 | 180 | 96 | 180 | 5.33 | 230 | 16.4 | 46.7 | 131 | 133 | 0.145 |
| 9 | 18 | 175 | 100 | 175 | 5.56 | 353 | 25.2 | 38.5 | 131 | 134 | 0.148 |

We claim:

1. Fibers comprising a polyoxymethylene copolymer having an ISO 1133 MVR melt index (determined at 190° C. under a load of 2.16 kg) in the range from 0.3 to 30 ml/10 mm which possess a bend recovery (measured by the double loop method in air and/or water) of not less than 125° C.

2. The fibers according to claim 1 wherein the polyoxymethylene copolymer has a melting point of not less than 140° C. and a weight average molecular weight $M_w$ in the range from 5000 to 200 000.

3. The fibers according to claim 1 wherein the polyoxymethylene copolymer has an MVR value (190/2.16) in the range from 1 to 10 ml/10 min.

4. The fibers according to claim 1 wherein the polyoxymethylene copolymer, as well as recurring oxymethylene groups, comprises from 0.5 to 10 mol % of structural units derived from comonomers.

5. The fibers according to claim 1 wherein the polyoxymethylene copolymer has a crystallization half-life of not less than 30 seconds and preferably not less than 100 seconds, determined by cooling from 200° C. to a temperature which is 10° C. below the melting temperature of that POM copolymer at a cooling rate of 80° C./minute and maintaining this temperature at this observation temperature.

6. The fibers according to claim 5 which comprise no nucleating agents.

7. The fibers according to claim 1 wherein the polyoxymethylene copolymer, as well as recurring oxymethylene groups of the formula I, comprises from 0.5 to 10 mol % of oxyalkylene groups of the formula II $$—[CH_2—O]— \quad (I),$$

$$—[(CH_2—)_m—O]_y— \quad (II)$$

where m is an integer from 2 to 4 and y is 1 or 2.

8. The fibers according to claim 1 which possess a bend recovery (measured by the double loop method in air and/or water) of not less than 130°.

9. The fibers according to claim 1 which possess a DIN 53 834-1 tensile strength of up to 45 cN/tex.

10. The fibers according to claim 1 which possess a DIN 53834-1 breaking extension of up to 100%.

11. The fibers according to claim 1 which are monofilaments.

12. A process for producing the fibers according to claim 1 which comprises the measures of i) extruding a melt comprising a polyoxymethylene copolymer having an ISO 1133 MVR melt index (determined at 190° C. under a load of 2.16 kg) in the range from 0.3 to 30 ml/10 min through a spinneret die, ii) introducing the resultant filament into a bath of liquid having a temperature of less than 150° C., iii) withdrawing the resultant filament, iv) single or multiple drawing to an overall draw ratio of not more than 6:1, and v) optionally heating the drawn filament while allowing shrinkage.

13. The fibers according to claim 1 wherein the polyoxymethylene copolymer has a melting point of not less than 140° C. and a weight average molecular weight $M_w$in the range from 7000 to 150 000.

14. The fibers according to claim 1 wherein the polyoxymethylene copolymer has an MVR value (190/2.16) in the range from 1 to 3 ml/10 min.

15. The fibers according to claim 1 wherein the polyoxymethylene copolymer, as well as recurring oxymethylene groups, comprises from 1 to 5 mol % of structural units derived from comonomers.

16. The fibers according to claim 1 wherein the polyoxymethylene copolymer, as well as recurring oxymethylene groups, comprises from 1.5 to 4 mol % of structural units derived from comonomers.

17. The fibers according to claim 1 wherein the polyoxymethylene copolymer, as well as recurring oxymethylene groups of the formula I, comprises from 1 to 5 mol % from 1.5 to 3 mol % of oxyalkylene groups of the formula II $$—[CH_2—O]— \quad (I),$$

$$—[(CH_2—)_m—O]_y—(II)$$

where m is 2 and y is 1 or 2.

18. The fibers according to claim 1 which possess a DIN 53834-1 tensile strength of up to 40 cN/tex and a DIN 53834-1 breaking extension in the range from 25% to 100%.

19. A brush which comprises the fibers according to claim 1.

20. The brush according to claim 19 wherein the fibers are inserted in the form of monofilaments.

21. The brush according to claim 19 wherein the brush is a toothbrush, hairbrush, artist brush, writing brush, industrial brush, paint brush, paint roller, paint pad, cosmetic brush, road and domestic cleaning brush or a body care brush.

* * * * *